United States Patent [19]

Koike et al.

[11] Patent Number: 4,973,571

[45] Date of Patent: Nov. 27, 1990

[54] THERMOSENSITIVE RECORDING MATERIALS

[75] Inventors: Naomasa Koike, Tsuchiura; Atsuo Goto, Tsukuba, both of Japan

[73] Assignee: Mitsubishi Paper Mills Limited, Tokyo, Japan

[21] Appl. No.: 413,971

[22] Filed: Sep. 28, 1989

[30] Foreign Application Priority Data

Sep. 29, 1988 [JP] Japan ..... 63-246750

[51] Int. Cl.[5] ..... B41M 5/18

[52] U.S. Cl. ..... 503/207; 427/152; 503/200; 503/226

[58] Field of Search ..... 427/152; 503/200, 207, 503/226

[56] References Cited

FOREIGN PATENT DOCUMENTS 48-101942 12/1973 Japan ..... 503/226

5093 1/1984 Japan ..... 503/207

*Primary Examiner*—Pamela R. Schwartz

*Attorney, Agent, or Firm*—Cushman, Darby & Cushman

[57] ABSTRACT

There is disclosed a thermosensitive recording material, comprising a support, a thermosensitive recording layer coated on said support and comprising a dye precursor and a color developer capable of developing a color of said dye precursor upon heating, and an porous undercoat layer comprising any one selected from water soluble polymers and latex resins and coated between said support and said thermosensitive recording layer.

4 Claims, No Drawings

THERMOSENSITIVE RECORDING MATERIALS

BACKGROUND OF THE INVENTION

1. Field of the Invention

The present invention relates to thermosensitive recording materials having excellent thermal response and having minimized tailings or foreign matters adhered to the thermal head.

2. Discussion on Related Art

Thermosensitive recording materials are generally composed of a support having provided thereon a thermo-sensitive recording layer containing as major constituents an ordinarily colorless or slightly colored electron giving dye precursor and an electron receptive developer. When heated by means of a thermal head, thermal pen or laser beam, the dye precursor instantaneously reacts with the developer to form a recorded image, as disclosed in Japanese Patent KOKOKU (Post Exam. Publications) Nos. 43-4160, 45-14039, etc. Because of the advantages of relatively simple design of devices, easy maintenance and lack of noise, the recording devices employing such thermosensitive recording materials are being used in a wide field including recording instruments for measurements, facsimiles, printers, terminal devices for computers, labels, and automatic vending machines for railroad tickets and the like. Particularly in the field of facsimiles, the demand for thermal sensitive mode has been greatly increasing and the performance of facsimiles has becoming high speed due to reduction in transmission costs. Facsimiles have reduced the cost and minimized the energy consumption. In response to such high speed and low energy performance required for facsimiles, high sensitivity has been demanded for thermosensitive recording materials. On the other hand, dot density of a thermal head was generally 8 lines/mm but recently a density as high as 16 lines/mm has been used. In addition, a dot area has become small and, demands for printing small-sized characters in high image quality or printing characters with density gradation by Dither method have been increasing. Thus, good printability, namely, to obtain images faithfully reproduced from dots on a head has been in greater demand than ever.

Attempting to satisfy these requirements, adhesion between a recording sheet and a thermal head was improved by supercalendering to a strong degree but such a treatment resulted in defects of decreasing whiteness, i.e., so called background stain, and the like.

It is proposed in Japanese Patent Application KOKAI (Laid-Open) No. 56-27394 to provide an undercoat layer between a thermosensitive layer and the base paper. By the provision of an undercoat layer, high density images can be obtained in a small energy without any violent supercalendering and higher density can be achieved than before. It is believed that the provision of this undercoat layer would be effective for rendering the surface of a thermosensitive layer smooth after it is coated, by filling up unevenness of a support to provide a smooth surface.

As described above, by the provision of an undercoat layer, a higher density recording has been obtained than was known before. However, demands for much higher sensitivity and more improvement in the dot reproducibility in recent years cannot be dealt with simply by providing an undercoat layer merely aiming at smoothing the surface.

SUMMARY OF THE INVENTION

An object of the present invention is to provide thermosensitive recording materials having good thermal response and good dot reproducibility in response to requirements for higher sensitivity and improving dot reproducibility which could not be solved by the foregoing techniques as described above.

DETAILED DESCRIPTION OF PREFERRED EMBODIMENTS

The arrangement of the present invention is characterized in that a porous undercoat layer composed of water soluble high polymer or latex resin is formed between a support and a thermosensitive layer as an undercoat layer. The provision of this porous undercoat layer is considered to exhibit the effect of more effectively applying thermal energy from a thermal head to the thermosensitive recording layer due to the thermal insulation effect or pressure deforming property provided by the undercoat layer as well as the effect of forming a smoother surface by smoothing the irregularities of the support.

Further, when a thermosensitive layer is directly formed on a porous undercoat layer, a component melted by thermal energy from a thermosensitive head adheres thereto (tailings adhered to the thermal head) and may interrupt printing. To cope with this problem, a second undercoat layer mainly composed of a pigment may be formed between the thermosensitive recording layer and the porous undercoat layer to reduce an amount of tailings adhered to the thermal head. In particular, the employment of a pigment to the second undercoat layer which is able to absorb oil of at least 70 ml/100 g can effectively reduce the amount of the tailings adhered to the thermal head.

The porous undercoat layer according to the present invention is formed in such a manner that powder soluble to an organic solvent is suspended in an aqueous polymer solution or an aqueous polymer emulsion, coated to a support and rinsed by an organic solvent after it has been dried to remove the powder. The powder may be melted by heat in stead of being rinsed by the organic solvent to form the porous coated layer. In addition, this layer arrangement may be formed by a so-called bubble coating wherein a coating liquid containing gas is coated. The porous undercoat layer obtained as described above preferably has a mean pore diameter of about 0.1–5.0 μm.

Examples of the water soluble polymer and latex resin used here include starches, hydroxyethyl cellulose, methyl cellulose, carboxymethyl cellulose, gelatin, casein, polyvinyl alcohol, modified polyvinyl alcohol, sodium polyacrylate, acrylic amide/acrylate copolymer, acrylamide/acrylate/methacrylate ternary copolymer, alkali salts of styrene/maleic anhydride copolymer, alkali salts of ethylene/maleic anhydride copolymer, etc.; latexes such as polyvinyl acetate, polyurethane, polyacrylates, styrene/butadiene copolymer, acrylonitrile/butadiene copolymer, methyl acrylate/-butadiene copolymer, ethylene/vinyl acetate copolymer, etc. After the coated layer is formed, it may be cross-linked using a cross-linking agent.

Powder soluble to an organic solvent is a material in a powder state which is less hydrophilic, less absorbed to water soluble polymer or latex resin and soluble to a suitable organic solvent. Such material, which is solid at a room temperature, for example, as 2-benzyloxynaphthalene or the like is included in this powder.

Powder capable of being melted and eluted by heat is an organic material of which melting point is 30°–80° and wax or the like substantially insoluble to water is included in the powder.

A solvent for eluting powder soluble to an organic solvent must solve only the above power and must not solve water soluble polymer and latex resin and includes ordinarily used organic solvents such as, for example, benzene, toluene, ethyl acetate, alcohols, acetone, ethers, hexanes and the like.

They may be suitably selected for use in consideration of the kind of water soluble high polymer and latex resin.

Further, when a thermosensitive layer is directly coated on a porous undercoat layer, a color developing component melted by energy from a thermal head is absorbed into a hollow particle layer and a developed image is concealed with the reduction of an image concentration, and thus the adherence of tailings to the thermal head or sticking in printing may be caused. This drawback can be prevented by further forming an oil absorbing inorganic pigment layer on the porous undercoat layer as a second undercoat layer. The pigment used in the second undercoat layer according to the present invention may be made of a pigment ordinarily used for coated paper such as, for example, calcium carbonate, kaolin, calcined kaolin, zinc oxide, titanium oxide, aluminum hydroxide, zinc hydroxide, barium sulfate, silicon oxide or the like. The pigments of them which have an oil absorbing amount of at least 70 ml/100 g such as the calcined kaolin and silicon oxide are particularly preferable.

Desired characteristics can be provided by forming a thermosensitive layer on the undercoat layer formed as described above.

Dye precursors used in the present invention are not particularly limited so long as they are generally used for pressure-sensitive recording paper or thermosensitive recording paper. Specific examples include the following dye precursors.

(1) Triarylmethane compounds:

3,3-bis(p-dimethylaminophenyl)-6-dimethyl aminophthalide (Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethyl-indol-3-yl)-5-dimethylaminophthalide, 3,3-bis(1,2-dimethylindol-3-yl)-6-dimethylaminophthalaide, 3,3-bis(9-ethylcarbazol-3-yl)-5-dimethylaminophthalaide, 3,3-bis(2-phenylindol-3-yl)-5-dimethylaminophthalide, 3-p-dimethylaminophenyl-3-(1-methylpyrrol-2-yl)-6-dimethylaminophthalide, etc.

(2) Diphenylmethane compounds:

4,4'-bis-dimethylaminophenyl benzhydryl benzyl ether, N-halophenyl leuco Auramine, N-2,4,5-trichlorphenyl leuco auramine, etc.

(3) Xanthene compounds:

Rhodamine B anilinolactam, Rhodamine B p-chloroanilinolactam, 3-diethylamino-7-dibenzylaminofluorane, 3-diethylamino-7-octylaminofluorane, 3-diethylamino-7-phenylfluorane, 3-diethylamino-7-chlorofluorane, 3-diethylamino-6-chloro-7-methylfluorane, 3-diethylamino-7-(3,4-dichloroanilino)fluorane, 3-diethylamino-7(2-chloroanilino)fluorane, 3-diethylamino-6-methyl-7-anilinofluorane, 3-(N-ethyl-N-tolyl)amino-6-methyl-7phenethylfluorane, 3-diethylamino-7-(4-nitroanilino)fluorane, 3-dibutylamino-6-methyl-7-anilinofluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl-)amino-6-methyl-7-anilinofluorane, 3-(N-ethyl-N-tetrahydrofuryl)amino-6-methyl-7-anilinofluorane, etc.

(4) Thiazine compounds:

benzoyl leuco methylene blue, p-nitrobenzoyl leuco methylene blue, etc.

(5) Spiro compounds:

3-methyl-spiro-dinaphthopyran, 3-ethyl-spirodinaphthaopyran, 3,3'-dichloro-spiro-dinaphthopyran, 3-benzylspiro-dinaphthaopyran, 3-methylnaphtho-(3-methoxybenzo)spiropyran, 3-propyl-spiro-benzopyran, etc. These dye precursors can be used singly or as admixtures of two or more.

As dye developers used in the present invention, electron accepting compounds generally employed for thermosensitive paper are used; in particular, phenol derivatives, aromatic carboxylic acid derivatives or metal compounds thereof, N,N'-diarylthiourea derivatives, etc. are used. Among them, particularly preferred ones are phenol derivatives Specific examples are p-phenylphenol, p-hydroxyacetophenone, 4-hydroxy-4'-methyldiphenylsulfone, 4-hydroxy-4'-isopropoxydiphenylsulfone, 4-hydroxy-4'-benzenesulfonyloxydiphenylsulfone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)-propane, 2,2-bis(p-hydroxyphenyl)butane, 2,2-bis(p-hydroxyphenyl)hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-di[2-(p-hydroxyphenyl)-2-propyl] benzene, 1,3-di[2-(3,4-dihydroxyphenyl)-2-propyl] benzene, 1,4-di[2-(p-hydroxyphenyl)-2-propyl] benzene, 4,4'-dihydroxydiphenyl ether, 4,4'-dihydroxydiphenylsulfone, 3,3'-dichloro-4,4'-dihydroxydiphenylsulfone, 3,3'-diallyl-4,4'-dihydroxydiphenylsulfone, 3,3'-dichloro-4,4'-dihydroxydiphenylsulfide, methyl 2,2-bis(4-hydroxyphenyl)acetate, butyl 2,2-bis(4-hydroxyphenyl)acetate, 4,4'-thiobis(2-t-butyl-5-methylphenol), bis(3-allyl-4-hydroxyphenyl)-sulfone, 4-hydroxy-4'-isopropyloxydiphenylsulfone, 3,4-dihydroxy-4'-methyldiphenylsulfone, benzyl p-hydroxybenzoate, chlorobenzyl p-hydroxybenzoate, propyl p-hydroxybenzoate, butyl p-hydroxybenzoate, dimethyl 4-hydroxyphthalate, benzyl gallate, stearyl gallate, salicylanilide, 5-chlorosalicylanilide, etc.

In addition, the thermosensitive layer may also contain as pigments diatomaceous earth, talc, kaolin, calcined kaolin, calcium carbonate, magnesium carbonate, titanium oxide, zinc oxide, silicon oxide, aluminum hydroxide, urea-formalin resin, etc., may further contain waxes such as N-hydroxymethylstearic amide, stearic amide, palmitic amide, etc.; naphthol derivatives such as 2-benzyloxynaphthalene, etc.; biphenyl derivatives such as p-benzylbiphenyl, 4-allyloxybiphenyl, etc.; polyether compounds such as 1,2-bis(3-methylphenoxy)ethane, 2,2'-bis(4-methoxyphenoxy)diethyl ether, bis(4-methoxyphenyl)ether, etc.; carbonate or oxalate diester derivatives such as diphenyl carbonate, dibenzyl oxalate, di(p-fluorobenzyl)oxalate, etc. for purposes of further improving the sensitivity.

In addition, there may be incorporated, for purposes of preventing head abrasion, prevention of sticking, etc., higher fatty acid metal salts such as zinc stearate, calcium stearate, etc.; waxes such as paraffin, oxidized paraffin, polyethylene, oxidized polyethylene, stearic amide, castor wax, etc.; dispersing agents such as sodium dioctylsulfosuccinate, etc.; UV absorbing agents of benzophenone type, benzotriazole type, etc. and further surface active agents, fluorescent dyes, etc., if necessary and desired.

In the present invention, as adhesives used for the thermosensitive recording layer and second undercoat layer used in the present invention, various adhesives generally used are usable. Examples of the adhesives include water soluble adhesives such as starches, hydroxyethyl cellulose, methyl cellulose, carboxymethyl cellulose, gelatin, casein, polyvinyl alcohol, modified polyvinyl alcohol, sodium polyacrylate, acrylic amide/acrylate copolymer, acrylamide/acrylate/methacryalte ternary copolymer, alkali salts of styrene/maleic anhydride copolymer, alkali salts of ethylene/maleic anhydride copolymer, etc.; latexes such as polyvinyl acetate, polyurethane, polyacrylates, styrene/butadiene copolymer, acrylonitrile/butadiene copolymer, methyl acrylate/butadiene copolymer, ethylene/vinyl acetate copolymer, etc. As the support used in the present invention, paper is mainly used. Non-woven cloth, a plastic film, synthetic paper, metal foil and the like or a composite sheet obtained by combining them may optionally be employed.

(E) EXAMPLES

Next, the present invention will be described in more detail by referring to the examples.

Parts and % shown below are all based on weight. Numeral values representing coated amounts or coverages are dry weights, unless otherwise indicated.

Example 1

(1) Preparation of Suspension A (coating liquid for the first undercoat layer)

A mixture having the following composition was stirred to prepare a coating liquid for the first undercoat layer.

| | |
|---|---|
| Aqueous solution containing 10% polyvinyl alcohol (as a water soluble polymer material) | 30 parts |
| 2-benzyloxynaphthalene (as powder soluble to organic solvent) dispersion (10% of polyvinyl alcohol was added to the solid, which was ground into a mean grain diameter of 1 μm with a sand grinder at the concentration of 30%.) | 23 parts |

(2) Preparation of Thermosensitive Suspension

A mixture having the following composition was ground into a mean grain diameter of about 1 μm with a sand grinder to prepare and [Suspension B] and [Suspension C], respectively.

| | |
|---|---|
| [Suspension B] | |
| 3,3-diethylamino-6-methyl 7-anilino fluorane | 40 parts |
| Aqueous solution containing 10% polyvinyl alcohol | 20 parts |
| Water | 40 parts |
| [Suspension C] | |

-continued

| | |
|---|---|
| Bisphenol A | 50 parts |
| 2-benzyloxynaphthalene | 50 parts |
| Aqueous solution containing 10% polyvinyl alcohol | 50 parts |
| Water | 100 parts |

Then, a thermosensitive suspension was prepared in the following formulation, using the thus prepared [Suspension B] and [Suspension C].

| | |
|---|---|
| [Suspension B] | 50 parts |
| [Suspension C] | 250 parts |
| Zinc stearate (40% dispersion) | 25 parts |
| Aqueous solution containing 10% polyvinyl alcohol | 216 parts |
| Calcium carbonate | 50 parts |
| Water | 417 parts |

The Suspension was prepared as above. Suspension A was coated to a base paper of 40 g/m$^2$ in such a manner that the weight thereof was made to 15 g/m$^2$ after it had been dried. Thereafter, a coated layer was rinsed by benzene as a solvent to elute 2-benzyloxynaphthalene and then dried. When this coated layer was observed by a scanning type electron microscope, it was confirmed that a porous layer was formed. Next, a thermosensitive layer was coated thereon in such a manner that the weight thereof was made to 5.5 g/m$^2$ after it had been dried to prepare a thermosensitive recording material.

Example 2

A thermosensitive layer was prepared in a manner similar to Example 1 except that the following Suspension D was coated before the formation of the thermosensitive layer in Example 1 in such a manner that the weight thereof was made to 5 g/m$^2$ after it had been dried.

(1) Preparation of Suspension D

A mixture having the following composition was stirred to prepare a coating liquid for the second undercoat layer.

| | |
|---|---|
| Ultra White-90 (kaolin made by Engelhardt Co., Ltd.) | 100 parts |
| Styrene-Butadiene copolymer latex (50% concentration) | 24 parts |
| Aqueous solution containing 10% MS4600 (starch made by Nihon Shokuhin K. K.) | 60 parts |
| Water | 52 parts |

Example 3

A thermosensitive layer was prepared in a manner similar to Example 1 except that the following Suspension E was coated before the formation of the thermosensitive layer in Example 1 in such a manner that the weight thereof was made to 5 g/m$^2$ after it had been dried.

(1) Preparation of Suspension E

A mixture having the following composition was stirred to prepare a coating liquid for the second undercoat layer.

| | |
|---|---|
| ANSILEX (calcined kaolin made by Engelhardt Co., Ltd. | 100 parts |
| Styrene-Butadiene copolymer latex (50% aqueous dispersion) | 24 parts |
| MS4600 (phosphoric acid ester starch made by Nihon Shokuhin K. K., 10% aqueous solution) | 60 parts |
| Water | 52 parts |

Example 4

A thermosensitive recording material was prepared in a manner similar to Example 3 except that an aqueous solution containing 10% styrene-maleic anhydride copolymer was used in place of the aqueous solution containing 10% polyvinyl alcohl used for the coating liquid for the first layer in Example 3.

Example 5

A thermosensitive recording material was prepared in a manner similar to Example 3 except that 7.5 parts of ethylene-vinyl acetate latex (40% concentration) was used in place of the aqueous solution containing 10% polyvinyl alcohol used for the coating liquid for the first layer in Example 3.

Comparative Example 1

A thermosensitive recording material was prepared in a manner similar to Example 1 except that the first undercoat layer of Example 1 was not provided.

Comparative Example 2

A thermosensitive recording material was prepared in a manner similar to Example 3 except that the first undercoat layer of Example 3 was not provided.

Comparative Example 3

A thermosensitive recording material was prepared in a manner similar to Example 3 except that the first undercoat layer in Example 3 was not rinsed by benzene after it had been coated.

Comparative Example 4

A thermosensitive recording material was prepared by in a manner similar to Example 4 except that the first undercoat layer in Example 4 was not rinsed by benzene after it had been coated.

Comparative Example 5

A thermosensitive recording material was prepared in a manner similar to Example 5 except that the first undercoat layer in Example 5 was not rinsed by benzene after it had been coated.

The thermosensitive recording materials prepared as described above were treated by a super-calendering so as to have compiled with a Bekk's degree of smoothness varied between 400 and 500 seconds. And these materials were compared with respect to recording density, printability and degree of adhering tailings or foreign matters using a GIII facsimile test machine. The test machine was (TH-PMD) manufactured by Okura Denki Co., Ltd. Printing was performed using with a thermal head showing its dot density of 8 dots/mm and its head resistance of 185 ohm at a head voltage of 11 V, for its load time of 0.6 ms. The recording density was measured with Macbeth RD-918 reflection desnsitometer. These results are shown in Table 1.

(F) Advantages

As apparent from Table 1, the thermosensitive recording material according to the present invention improves a thermal response by the provision of the porous undercoat layer with the first layer and reduces foreign matters adhered to the thermal head by the provision of the pigment layer as the second undercoat layer. In particular, an amount of the foreign matters is greatly reduced by using a pigment capable of absorbing oil of at least 70 ml/100 g.

TABLE 1

| | development concentration | printability | tailings |
|---|---|---|---|
| Example | | | |
| 1 | 1.01 | O | Δ |
| 2 | 1.03 | O | O~Δ |
| 3 | 1.05 | O | O |
| 4 | 1.02 | O | O |
| 5 | 1.02 | O | O |
| Comparative Example | | | |
| 1 | 0.53 | X | X |
| 2 | 0.88 | Δ | O |
| 3 | 0.90 | Δ | O |
| 4 | 0.89 | Δ | O |
| 5 | 0.84 | Δ | O |

O: good
O~Δ: relatively good
Δ: lower limit for use
X: bad

What is claimed is:

1. A thermosensitive recording material comprising a support, a thermosensitive recording layer coated on said support comprising a dye precursor, a color developer capable of developing a color of said dye precursor upon heating and an adhesive, a porous first undercoat layer between said support and said thermosensitive recording layer comprising at least one member of the group consisting of water soluble polymers and latex resins, and a second undercoat layer sandwiched between said thermosensitive layer and said first undercoat layer comprising a pigment and an adhesive.

2. A thermosensitive recording layer according to claim 1, wherein said porous first undercoat layer is formed by eluting powder soluble in an organic solvent using an organic solvent.

3. A thermosensitive recording layer according to claim 1, wherein said porous first undercoat layer is formed by eluting thermally soluble powder using heat.

4. A thermosensitive recording layer according to claim 1, wherein said pigment comprises at least 70 ml/100 g of an oil-absorbing compound.

* * * * *